United States Patent [19]

Reese et al.

[11] 3,933,021

[45] Jan. 20, 1976

[54] PROCESS OR METHOD OF PRODUCING A SMALL OPENING IN A RELATIVELY THICK METALLIC OR PIPE WALL

[75] Inventors: Burkhart Reese, Eitorf; Lothar Schick, Windeck, Herchen, both of Germany

[73] Assignee: Boge GmbH, Eitorf,Sieg, Germany

[22] Filed: Aug. 28, 1974

[21] Appl. No.: 501,234

[30] Foreign Application Priority Data

Aug. 29, 1973 Germany ..... 2343432

[52] U.S. Cl. ..... 72/327

[51] Int. Cl.[2] ..... B21D 28/24

[58] Field of Search ..... 72/71, 254, 325, 327; 83/54, 660

[56] References Cited

UNITED STATES PATENTS

| | | | |
|---|---|---|---|
| 68,187 | 8/1867 | Hamilton | 72/327 |
| 2,145,725 | 1/1939 | Jamieson | 83/660 |
| 2,478,962 | 10/1949 | Ziehmer, Jr. | 72/327 |
| 3,044,167 | 7/1962 | Mathieu | 72/327 |
| 3,698,274 | 10/1972 | Coulon et al. | 83/54 |

*Primary Examiner*—Lowell A. Larson

*Attorney, Agent, or Firm*—Larson, Taylor & Hinds

[57] ABSTRACT

The problem of producing small openings in a relatively thick wall, such as a pipe wall of a working cylinder of a shock absorber, is solved in accordance with the invention by placing the wall on a die with an opening that is the same or substantially the same as the opening that is to be produced, and forcefully penetrating the wall with the conical tip of a tool aligned with the die opening, the depth of penetration corresponding substantially to the thickness of the wall at the point of penetration. This forces part of the material of the wall into the die opening, and, upon further penetration to approximately the thickness of the wall, the material forced into the die opening is sheared off at the edge of the die opening, such that the sheared material can detach from the wall before the conical tip is seated in the die opening. Openings produced successively in this manner are almost identical, and the operation does not leave burrs, the wall face which was lying against the die remaining smooth.

8 Claims, 6 Drawing Figures

PROCESS OR METHOD OF PRODUCING A SMALL OPENING IN A RELATIVELY THICK METALLIC OR PIPE WALL

FIELD OF THE INVENTION

This invention relates to a method or process for producing a small opening in a relatively thick metallic sheet or pipe wall, especially the wall of automobile shock absorber pipes.

BACKGROUND AND SUMMARY

In hydraulic shock absorbers as known, for instance, from German Offenlegungsschrift No. 2,146,222, for braking the shock on structural parts of automotive vehicles, there are small openings in the relatively thick inner pipe wall of a working cylinder, the cylinder being made of very strong material, and the openings being successively covered by a working piston upon actuation of the shock absorber, and thus determining the characteristic of the braking force. Cutting type production (e.g., boring) or these openings, which commonly are of 0.4 to 1 mm diameter, for example, is normally too expensive for series manufacture of shock absorbers in large numbers, because of considerable wear on the small boring tools, and because of the need to remove the burrs in a subsequent work step. Noncutting production by stamping with punch and die in the customary way, wherein the punch diameter is substantially the same as the hole diameter, is out of the question if holes of the exemplary diameters previously mentioned are to be produced where the wall thickness is two to three mm, as occurs in the particular example given. Under such circumstances, the punch immediately bends and becomes unusable from the forces involved.

The problem confronted by Applicants, namely production of small openings in a relatively thick pipe wall, is solved in accordance with the instant invention in that the wall lies on a die with an opening that is the same or substantially the same as the opening that is to be produced, and a conical tip of a working tool is forcefully guided to penetrate into the wall in alignment with the die opening, the depth of penetration corresponding approximately to the wall thickness.

From German Pat. No. 958,800, a process is known for production of a small opening in a platelike object by means of a tool or mandrel. In this process, there is borne on an incompressible plastic mass a metallic intermediate plate, and then on this another metallic intermediate plate is placed, and the object to be formed with an opening is placed on the upper intermediate plate. A mandrel with a conical tip is pressed into the object so far that a through opening is produced in it by tearing. There is the drawback that there is no guarantee of freedom from burrs, or of preciseness of opening dimensions. This known process entails a conical bending of the platelike object, and would not be suitable for the purposes of the present invention, where there is to be no supplementary deformation on the opening side of the sheet or pipe wall that is to be provided with an opening, as in a shock absorber, which must remain round.

The process or method of the instant invention offers substantial cost advantages as opposed to cutting production of small holes in a thick wall. In the process, there is necessarily a conical widening of the wall opening, which is desired in the case of the shock absorber mentioned previously. In a simple way, there are produced shutterlike jet openings for the stream of liquid flowing outward from a working cylinder, the openings having a stable flow characteristic that is slightly dependent upon viscosity. Such a flow characteristic is a condition to uniform action of a shock absorber.

In the process of the invention, there first is an impression of the sheet or pipe wall with the conical tip of the tool. The tip penetrates into the wall, whereby the material is caused to flow. With further penetration of the conical tip, part of the material of the wall is forced into the die opening. With still further penetration, corresponding approximately to the thickness of the wall, the lump of material forced into the die opening is sheared off at the edge of the die opening, whereby the lump can detach from the wall before the conical tip is seated in the die opening. Hereby the actual opening is produced, its size being determined by the size of the die opening. The shearing off of the lump of material below the punch occurs surprisingly and advantageously so uniform that openings successively produced are almost identical, and without burrs. Different opening cross sections can be produced by suitable configurations of the conical tip.

Further characteristics, features, advantages and the like of the invention will be apparent to those skilled in the art from the ensuing description taken in conjunction with the appended drawings.

DESCRIPTION OF THE PREFERRED EMBODIMENTS

Figure 1:
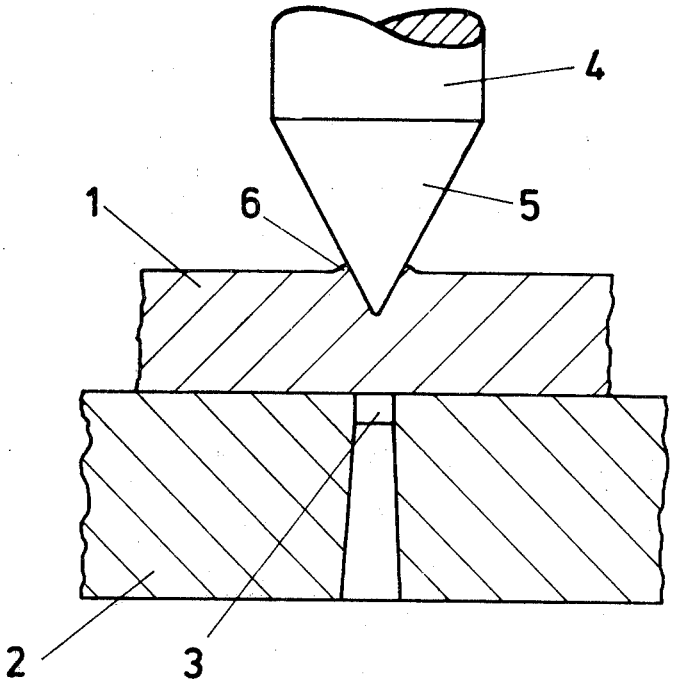
FIG. 1 shows a sheet or pipe wall on a die, in section, with the conical tip penetrating somewhat into the wall.
Figure 2:
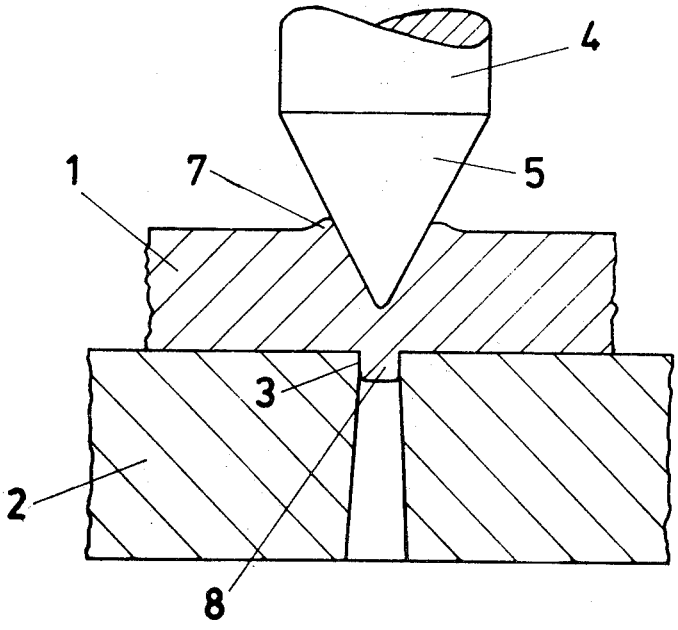
FIG. 2 shows the parts as in FIG. 1, with deeper penetration of the conical tip.
Figure 3:
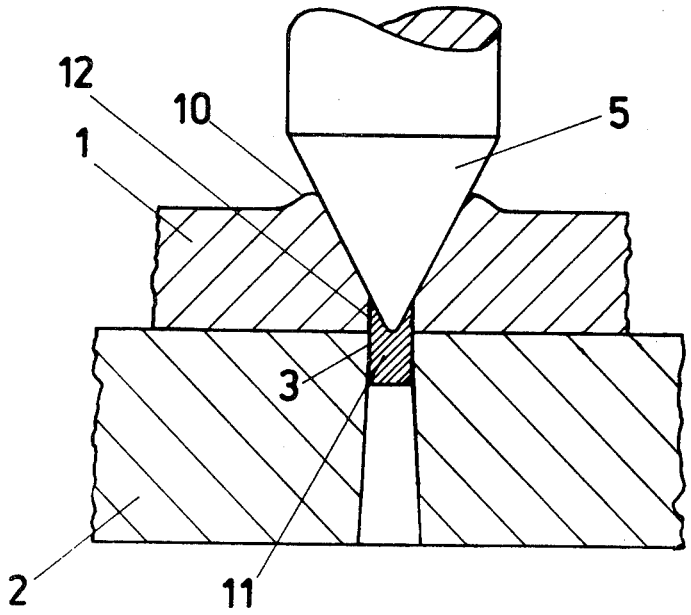
FIG. 3 shows the parts as in FIG. 1 after penetration to a depth that corresponds to the thickness of the wall.

Referring to the drawings, the parts illustrated in FIGS. 1–3, namely a tool 4 with conical tip 5 and a die 2 with small opening 3, are held guided in a conventional device which is not illustrated, whereby conical tip 5 is movable in the direction toward opening 3 of die 2. A relatively thick sheet or pipe wall 1 that is to be provided with a small opening is placed on die 2, the distance from conical tip 5 to die 2 being then greater than the thickness of wall 1. In the illustrated position of FIG. 1, conical tip 5 has penetrated somewhat into wall 1 and has produced a small impression ridge 6 against the pressed direction of tool 4 on wall 1.

In FIG. 2 the conical tip 5 has penetrated more deeply into wall 1, whereby there is a higher impression ridge 7, and a small amount of material 8 of wall 1 has been forced into opening 3 of die 2.

In FIG. 3, conical tip 5 has penetrated by an amount that corresponds to the thickness of wall 1, so that there is a still higher impression ridge 10, and a lump of material 11 has been detached from wall 1, with formation of shearing surfaces 12. To illustrate this clearly, lump 11 has been shown more closely hatched than wall 1.

Lump 11 can now fall through die 2, or in production of another opening in the wall it will be pushed out by the same tool or by another tool. Impression ridge 10 is functionally insignificant in most cases, and therefore does not require removal, particularly in the case of shock absorber pipes as previously mentioned.

Figure 4:
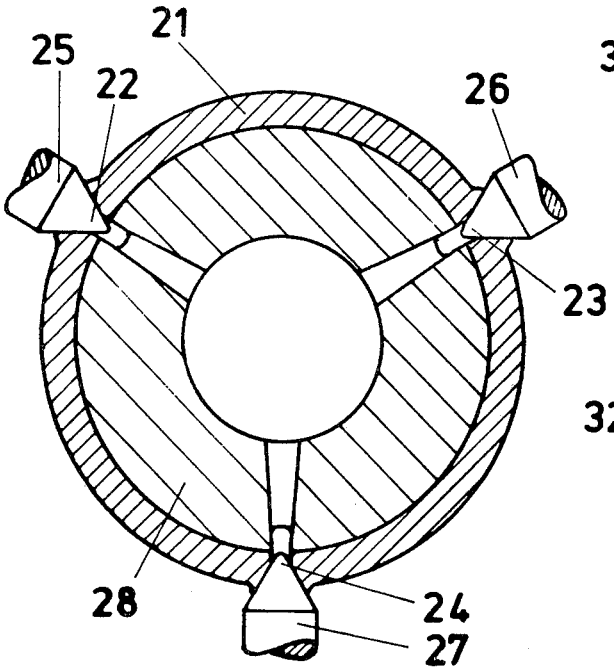
FIG. 4 shows a pipe in cross section, with a ring die incorporated therein, and with three conical tips pressing into the wall from the outside.

In the embodiment shown in FIG. 4, three openings, 22, 23 and 24 are simultaneously produced in the wall of a pipe 21, where three tools 25, 26 and 27 with concial tips are guided and moved by an unillustrated device that may be considered conventional, against a die ring 28. Here the die ring 28 does not need separate support to counter the tool pressure of conical tips 25, 26 and 27.

Figure 5:
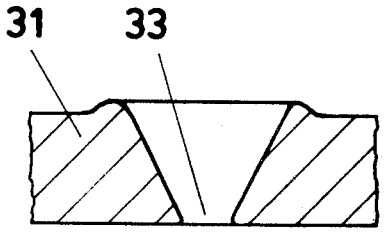
FIGS. 5 and 6 show examples of different opening cross sections which can be made by the process of method of the instant invention.
Figure 6:
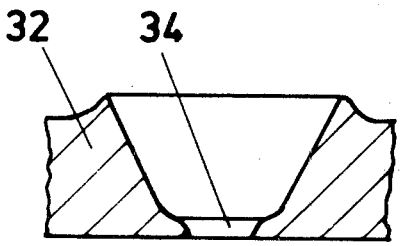

In FIGS. 5 and 6, openings 33 and 34 of exemplary different cross sections are shown produced in walls 31 and 32 by the method of the invention, using, for instance, suitably shaped removable conical tips.

Using the same tools, it is possible according to the invention to produce a large number of close tolerance openings in a steel wall, up to the point at which the strength of the conical tip or the die is exceeded. The tools then have to be either exchanged or reworked. In some circumstances there can be a further work step, for example, a simple calibrating operation.

We claim:

1. In a method for producing a small opening in a relatively thick metallic wall, the steps comprising placing one face of the wall on a die formed with an opening corresponding substantially to the opening that is to be produced in the wall, positioning a tool formed with a generally conical tip adjacent the other face of the wall such that the conical tip is aligned with the opening in said die, and forcing said conical tip into said wall to a penetration depth approximately equal to the thickness of the wall at the point of penetration to force a portion of the wall metal into the die opening and shear it from the metallic wall.

2. A method as claimed in claim 1 wherein said metallic wall is the wall of a shock absorber pipe, and said one and other faces are respectively the inner and outer surfaces of the pipe.

3. A method as claimed in claim 2 wherein said pipe is cylindrical and said die is cylindrical and disposed inside the pipe.

4. A method as claimed in claim 3 wherein said die is formed with a plurality of openings, and a corresponding plurality of tools are provided to produce a plurality of openings simultaneously.

5. A method as claimed in claim 1 wherein the point of said conical tip is substantially smaller in diameter than the diameter of the opening in said die and the conical tip flares outwardly therefrom to a diameter substantially greater than the diameter of said die opening.

6. A method as claimed in claim 5 wherein the axial distance between the point of said conical tip and the area thereof which initially exceeds the diameter of said die opening is less than the thickness of the wall at said point of penetration such that a substantial portion of the conical tip which penetrates said wall is of greater diameter than said die opening.

7. A method as claimed in claim 6 wherein the penetrating movement of said tool is stopped short of the point at which said conical tip would be seated in the die opening.

8. A method as claimed in claim 7 wherein said one face of said wall corresponds closely in configuration to the surface of said die and lies against said die surface, and said opening in said die opens abruptly into the die surface, such that the configuration of said one face of said wall surrounding the opening formed therein remains substantially unaltered after formation of said opening.

* * * * *